US005488829A

United States Patent [19]

Southall et al.

[11] Patent Number: 5,488,829

[45] Date of Patent: Feb. 6, 1996

[54] METHOD AND APPARATUS FOR REDUCING NOISE GENERATED BY COMBUSTION

[75] Inventors: Leslie R. Southall, Longwood, Fla.; Augustine J. Scalzo, Bensalem, Pa.

[73] Assignee: Westinghouse Electric Corporation, Pittsburgh, Pa.

[21] Appl. No.: 248,706

[22] Filed: May 25, 1994

[51] Int. Cl.[6] ..... F23R 3/12

[52] U.S. Cl. ..... 60/725; 60/759

[58] Field of Search ..... 60/722, 740, 743, 60/746, 748, 755, 759, 760, 39.36, 725; 431/173, 114

[56] References Cited

U.S. PATENT DOCUMENTS

| | | | |
|---|---|---|---|
| 1,591,679 | 7/1926 | Hawley | 431/173 |
| 2,659,201 | 11/1953 | Krejci | 60/759 |
| 3,099,134 | 7/1963 | Calder et al. | 60/752 |
| 3,643,430 | 2/1972 | Emory, Jr. et al. | 60/759 |
| 4,891,936 | 1/1990 | Shekleton et al. | 60/755 |
| 4,928,479 | 5/1990 | Shekleton et al. | 60/746 |
| 5,263,316 | 11/1993 | Shekleton et al. | 60/760 |

*Primary Examiner*—Timothy S. Thorpe

[57] ABSTRACT

A combustor in which fuel is introduced into a combustion zone at a first acute angle with respect to the radially outward direction so as to swirl the fuel about the combustor axis, thereby improving the stability of the combustion process. Combustion air is introduced into the combustion zone at a second acute angle with respect to the radially inward direction so as to swirl the air about the combustor axis in the same circumferential direction that the fuel is swirled, with the first and second acute angles being approximately equal. By swirling the combustion air in a manner that is compatible with the swirling of the fuel, noise associated with the combustion process is reduced.

23 Claims, 3 Drawing Sheets

METHOD AND APPARATUS FOR REDUCING NOISE GENERATED BY COMBUSTION

BACKGROUND OF THE INVENTION

The present invention relates to a method and apparatus for reducing the level of noise generating by a combustion process. More specifically, the present invention relates to a reduced noise generating combustor in which the fuel is circumferentially swirled around the combustion zone.

In a gas turbine, fuel is burned in compressed air, produced by a compressor, in one or more combustors. Traditionally, such combustors include a cylindrical liner that encloses a primary combustion zone in which an approximately stoichiometric mixture of fuel and air is formed and burned in a diffusion type combustion process.

Traditionally, fuel is introduced into the primary combustion zone by a fuel nozzle that directs the fuel at an angle with respect to both the radial and axial directions—that is, the fuel is simultaneously directed axially downstream and radially outward—so as to create vortices that aid in mixing the fuel and air and stabilizing the flame. However, the fuel nozzle did not circumferentially swirl the fuel around the combustion zone. Thus, if the direction of the flow from the fuel nozzle were projected onto a plane perpendicular to the axis of the combustor, the angle at which the fuel was directed would be exactly radially outward (i.e., the angle at which the fuel is directed is 0° from the radially outward direction).

in the traditional approach, combustion air is introduced into the combustion zone in two ways. A minor portion of the combustion air is introduced axially into the combustion zone by an annular passage that surrounds the fuel nozzle. Vanes are distributed around the outlet of this annular passage and serve to swirl the axially introduced portion of the combustion air. The swirl imparted to the axially introduced portion of the combustion air aids the mixing of the fuel and air and the stabilizing of the flame.

The major portion of the combustion air is introduced radially into the combustion zone. This is accomplished by a plurality of tubular member—sometimes referred to as "air scoops"—distributed around the combustor liner. The air scoops direct the air radially inward (i.e., the angle at which the air is directed is 0° from the radially inward direction) so that, like the fuel, the radially introduced portion of the combustion air is not circumferentially swirled around the combustion zone.

Cooling air is also introduced into the combustor axially and radially. The majority of such cooling air is introduced radially into the combustor downstream of the primary combustion zone and serves to cool the hot gases prior to expansion in the turbine. A smaller amount of cooling air is introduced axially into the combustor through annular passages formed between adjoining sections of the combustor liner and serves to cool the liner walls.

Unfortunately, the amount of nitrogen oxides (NOx) generated by the combustion process in the traditional combustors is high. Consequently, attempts have been made to reduce NOx generation by dramatically reducing the fuel/air ratio and, therefore, the combustion temperature. Unfortunately, such lean burning can reduce the stability of the combustion process. Efforts have been made to offset this reduction in stability by directing the fuel into the combustion zone so as to impart a circumferential swirl component to the fuel.

Unfortunately, it has been found that swirling the fuel increases the noise generated by the combustion process. It is therefore desirable to provide a combustor having the benefits associated with the swirling of the fuel without an appreciable increase in the sound level generated by the combustion process.

SUMMARY OF THE INVENTION

Accordingly, it is the general object of the current invention to provide a combustor having the benefits associated with the swirling of the fuel without an appreciable increase in the sound level generated by the combustion process.

Briefly, this object, as well as other objects of the current invention, is accomplished in a combustor comprising (i) a liner for enclosing a combustion zone in which fuel and air are burned, the liner defining an axis of the combustor, (ii) means for introducing the fuel into the combustion zone, the fuel introducing means having means for swirling the fuel circumferentially around the axis, and (iii) means for introducing the air tangentially into the combustion zone at a first acute angle relative to a first radial direction so as to swirl the air circumferentially around the axis.

In one embodiment of the invention, the means for swirling the fuel comprises means for directing the fuel at a second acute angle relative to a second radial direction, with the first and second angles differing by less than approximately 15°. In this embodiment, the means for swirling the fuel and the means for introducing the air tangentially into the combustion zone cooperate to swirl the fuel and the air in the same circumferential direction.

The current invention also encompasses a method of reducing the noise generated by combusting fuel in air comprising the steps of (i) forming a combustion zone within a combustor, (ii) introducing fuel into the combustion zone and swirling the fuel circumferentially therearound, and (iii) introducing air into the combustion zone at a first acute angle to a first radial direction so as to swirl the air circumferentially therearound.

DESCRIPTION OF THE PREFERRED EMBODIMENT

Figure 1:
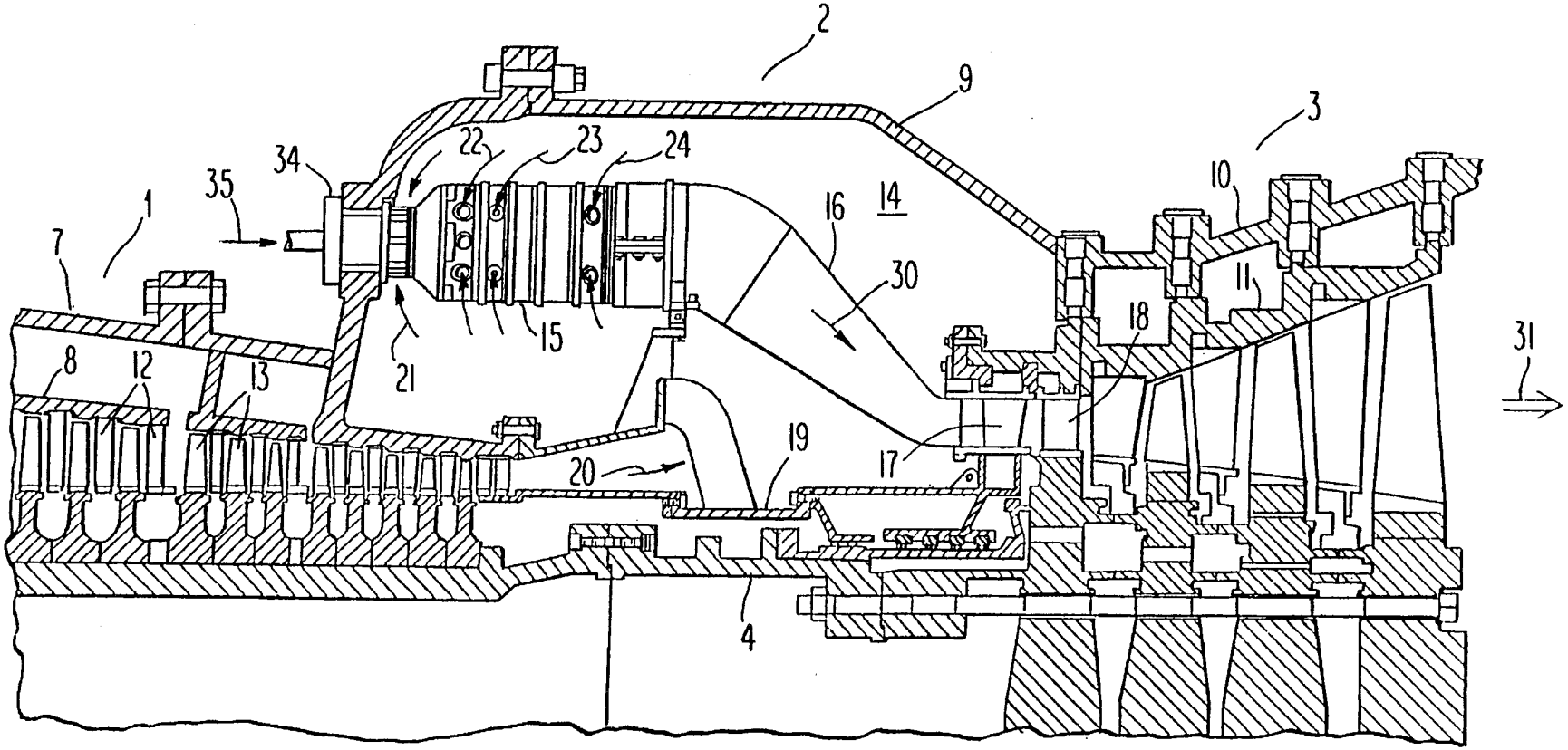
FIG. 1 is a longitudinal cross-section through a portion of a gas turbine incorporating the combustor of the current invention.

Referring to the drawings, there is shown in FIG. 1 a longitudinal cross-section through a portion of a gas turbine. The major components of the gas turbine are a compressor section 1, a combustion section 2, and a turbine section 3. As can be seen, a rotor 4 is centrally disposed and extends through the three sections. The compressor section 1 is comprised of cylinders 7 and 8 that enclose alternating rows of stationary vanes 12 and rotating blades 13. The stationary vanes 12 are affixed to the cylinder 8 and the rotating blades 13 are affixed to discs attached to the rotor 4.

The combustion section 2 is comprised of an approximately cylindrical shell 9 that forms a chamber 14 together with the aft end of the cylinder 8 and a housing 19 that encircles a portion of the rotor 4. A plurality of combustors 15 and ducts 16 are contained within the chamber 14. The ducts 16 connect the combustors 15 to the turbine section 3. Fuel 35, which may be in liquid or gaseous form—such as distillate oil or natural gas—enters each combustor 15 through a fuel nozzle 34 and is burned therein so as to form a hot gas 30. The turbine section 3 is comprised of an outer cylinder 10 that encloses an inner cylinder 11. The inner cylinder 11 encloses rows of stationary vanes 17 and rows of rotating blades 18. The stationary vanes 17 are affixed to the inner cylinder 11 and the rotating blades 18 are affixed to discs that form a portion of the turbine section of the rotor 4.

In operation, compressed air 20 from the compressor section 1 enters the chamber 14 and is then distributed to each of the combustors 15. In the combustors 15, the fuel 35 is mixed with the compressed air and burned, thereby forming the hot compressed gas 30. The hot compressed gas 30 flows through the ducts 16 and then through the rows of stationary vanes 17 and rotating blades 18 in the turbine section 3, wherein the gas expands and generates power that drives the rotor 4. The expanded gas 31 is then exhausted from the turbine 3.

Figure 2:
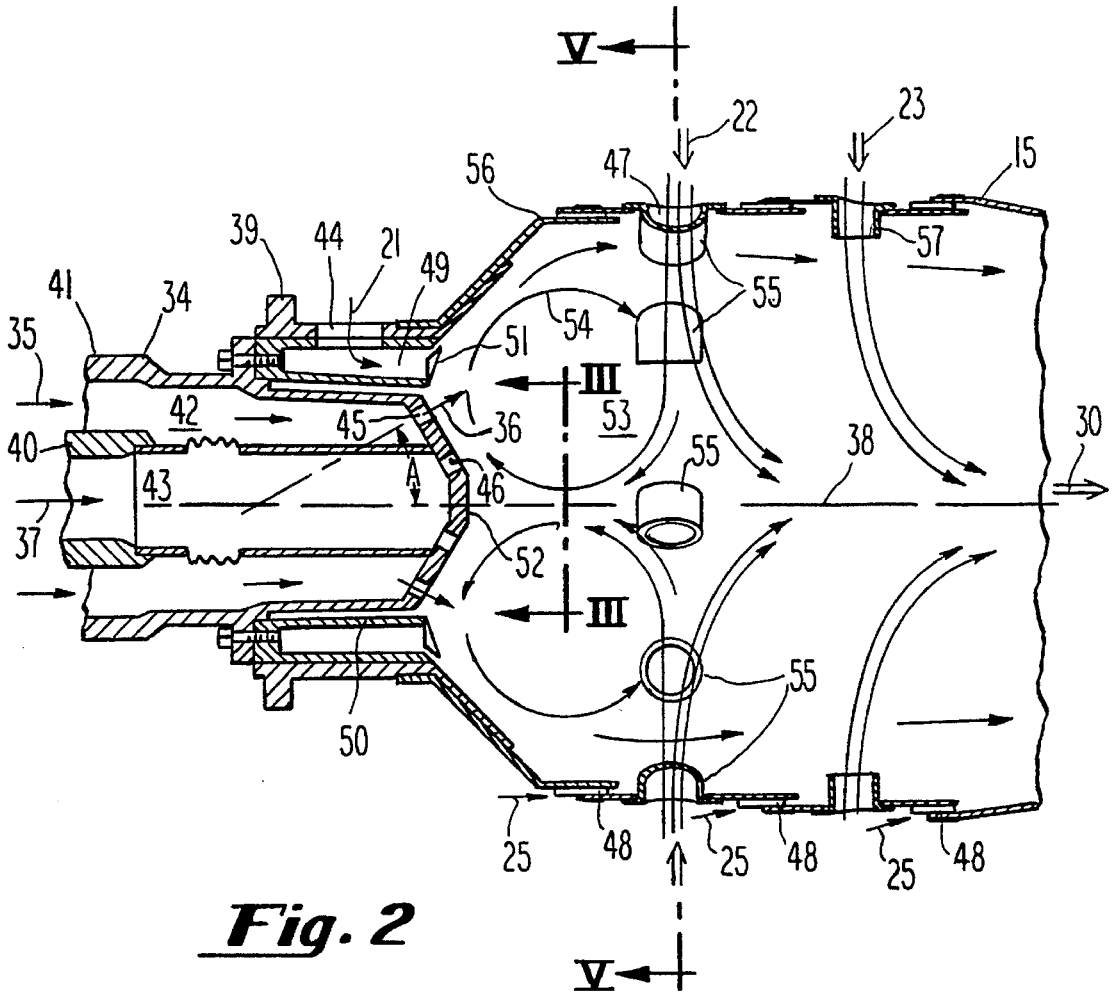
FIG. 2 is a longitudinal cross-section through the upstream portion of the combustor shown in FIG. 1.
Figure 3:
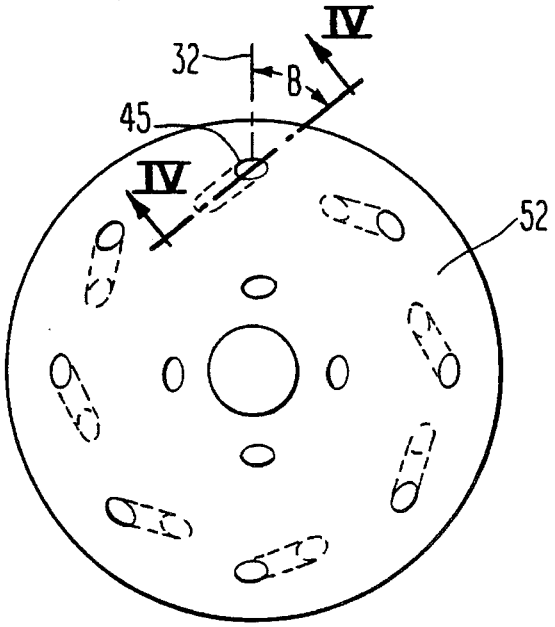
FIG. 3 is a view of the face of the fuel nozzle taken along line III—III shown in FIG. 2.

The fuel nozzle 34 is shown in detail in FIGS. 2 and 3. In the preferred embodiment, the fuel nozzle 34 is comprised of inner and outer cylindrical members 40 and 41, respectively, joined by an approximately frusto-conical nozzle face 52. The inner and outer cylindrical members 40 and 41 form an annular passage 42 between themselves. The annular passage 42 terminates in a circular array of fuel passages 45 formed in the nozzle face 52. The outlets of the passages 45 form fuel ports that discharge the fuel 35 from the nozzle 34.

As shown in FIG. 2, the fuel passages 45 divide the fuel 35 into a plurality of fuel streams 36 that are directed into a combustion zone 53 enclosed within a cylindrical combustor liner 56. Preferably, the portion of the nozzle face 52 in which the fuel passages 45 are formed is frusto-conical so as to be disposed at an angle to the combustor longitudinal axis 38 defined by the cylindrical combustor liner 56. Consequently, as is conventional, the fuel passages 45 direct the fuel streams 36 at an acute axial angle A to the combustor axis 38. In the preferred embodiment; the axial angle A is in the range of approximately 0° to 45°.

Figure 4:
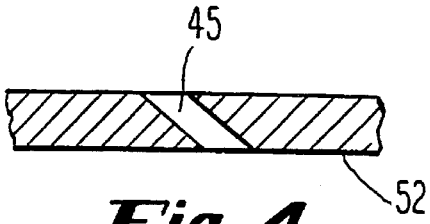
FIG. 4 is a cross-section through the face of the fuel nozzle taken along line IV—IV shown in FIG. 3.

As shown in FIGS. 3 and 4, the fuel passages 45 are also oriented at an acute tangential angle B to the radially outward direction 32. In the preferred embodiment, the tangential angle B is in the range of approximately 30° to 60°.

To avoid confusion, it should be noted that as a result of being inclined both axially and tangentially, as discussed above, the directions of the fuel passages 45 form angles both with respect to the axial direction, as shown in FIG. 2, and with respect to the radial direction, as shown in FIG. 3. Consequently, as can be seen in FIG. 2, merely by virtue of being oriented at the axial angle A relative to the combustor axis 38, the fuel streams 36 form an acute angle (i.e., equal to 90°-A) relative to the radially outward direction when viewed in a longitudinal cross-section, such as that shown in FIG. 2. In other words, when projected onto a plane in which the combustor axis lies, the passages formed by fuel passages 45 form an acute angle of 90°-A relative to the radial direction. However, this aspect of the fuel passage 45 orientation does not impart any circumferential swirl to the fuel streams 36 around the combustor axis 38. Rather, it merely aids in the creation of a toroidal vortex 54 when the fuel 36 combines with the compressed air 22, as discussed further below. For purposes of the current invention, the swirling nature of the fuel passages 45 is of particular interest. Thus, as used herein, reference to an acute tangential angle B relative to a radial direction refers to the angle made when the direction of a fuel stream 36 is projected onto a plane perpendicular to the combustor axis 38, as shown in FIG. 3. Thus, FIG. 2 reflects only the acute axial angle A and FIG. 3 reflects only the acute tangential angle B.

Returning to FIG. 2, the inner cylindrical member 40 of the fuel nozzle 34 forms a passage 43 that terminates in a circular array of steam passages 46 formed in the nozzle face 52. The passages 46 direct the steam 37 into the combustion zone 53. As is well known in the art, the injection of the steam 37 serves to reduce the generation of NOx. Like the fuel passages 45, the steam passages 46 are oriented at an acute axial angle to the combustor axis 38. In addition, the steam passages 37 may be oriented at 0° to the radially outward direction, as shown in FIG. 3, or they may be oriented at an acute tangential angle to the radially outward direction in a manner similar to that discussed above with respect to the fuel passages 45.

As shown in FIG. 2, compressed air from the compressor section 1 enters the combustor 15 in a variety of ways. A portion 21 of the compressed air 20 enters passages 44 formed in the combustor neck 39 and is then directed axially into the combustion zone 53 by an annular passage 49. The annular passage 49 is formed between the combustor neck 39 and a cylindrical portion of a stabilizer 50. As shown FIGS. 2 and 5, a circumferential array of vanes 51 are formed at the end of the stabilizer 50. The vanes 51 serve to swirl the compressed air 21 that is introduced axially into the combustion zone 53 from the annular passage 49. This swirling aids in the mixing of the fuel streams 36 into the air 21 and helps to stabilize the flame.

Figure 5:
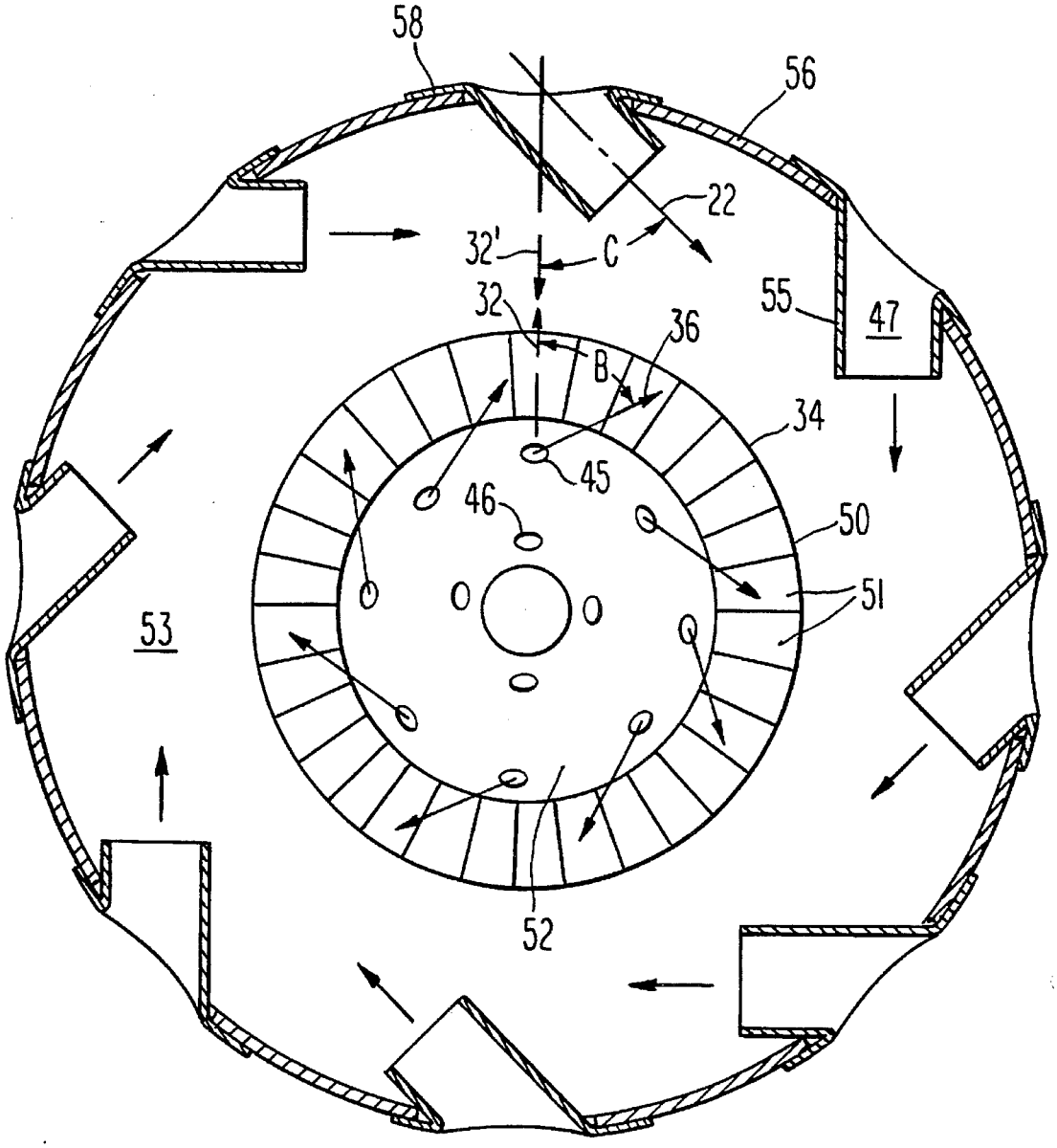
FIG. 5 is a transverse cross-section through the combustor of the current invention taken along line V—V shown in FIG. 2.

While the axially introduced compressed air 21 forms a portion of the stoichiometric combustion air for the fuel 35, the majority of the stoichiometric combustion air is formed by a portion of the compressed air 20 that enters the combustion zone 53 as a plurality of streams 22. As shown in FIGS. 2 and 5, the air streams 22 are directed into the combustion zone 53 by tubular primary air scoops 55. The primary air scoops 55 extend through openings formed in the combustor liner 56, to which they are attached by flanges 58 formed on their proximal ends. The primary air scoops 55 are arranged in a circular array that encircles the combustion zone 53. Air passages 47 formed within the primary air scoops 55 serve to direct the compressed air streams 22 into the combustion zone 53.

It has been found that when the fuel streams 36 are swirled, as discussed above, the noise generated by the combustion process in conventional combustors is increased, in some cases to objectionable levels. The combustion process in a combustor can be viewed as a standing wave in an organ pipe. It is theorized that in an arrangement in which neither the fuel streams 36 nor the combustion air streams 22 are swirled, the combustion process is velocity driven and the combustor 15 acts like an opened-end organ pipe for purposes of noise generation. However, the inventors have theorized that mixing the swirled fuel streams 36 into the un-swirled air streams 22, as was previously done, causes the combustion process to become pressure driven so that the combustor 15 acts like a closed-end organ pipe. Experience has shown that such a closed-end system generates greater noise levels.

Thus, according to the current invention, the noise generated by the combustion process is reduced by introducing the combustion air streams 22 into the combustion zone 53 in a novel way. Specifically, the air streams 22 are directed tangentially to the combustor axis 38, rather than perpendicularly to the axis as was previously done, as shown in FIG. 5.

As shown in FIG. 5, the air streams 22 are tangentially introduced by orienting the primary air scoops 55 so that their passages 47 are oriented at an acute tangential angle C to the radially inward direction 32'. Thus, the primary air scoops 55 swirl the air streams 22 around the combustor axis 38. Preferably, the angle C, and therefore the angle that the air streams 22 make with the radially inward direction 32', is within the range of 30° to 60°, like the angle B that the fuel streams 36 make with the radially outward direction 32. More preferably, the angle C is within 15° of the angle B, and most preferably the angles B and C are equal.

Although the air streams 22 and the fuel streams 36 are directed in opposing radial directions, with the air streams being directed generally radially inward (i.e., at angle C) and the fuel streams 36 being directed generally radially outward (i.e., at angle B), the swirl imparted to the air streams 22 by the primary air scoops 55 is complimentary to the swirl imparted to the fuel streams 36 by the fuel passages 45 in the sense that both are swirled in the same circumferential direction—i.e., clock-wise when viewed looking against the direction of flow, as in FIG. 5. In addition, in the preferred embodiment, the vanes 51 swirl the axially introduced portion 21 of the combustion air in the same circumferential direction that the fuel 36 and air 22 are swirled.

As shown in FIG. 2, although oriented tangentially to the combustor axis 38, in the preferred embodiment, the air passages 47 formed by the primary air scoops 55 lie in a plane that is substantially perpendicular to the combustor axis. However, the passages 47 could also be oriented at an acute axial angle to the combustor axis 38 in a manner similar to the fuel passage passages 45.

As shown in FIG. 2, the swirled streams of tangentially introduced air 22, as well as the swirled streams of axially introduced air 21, combine with the swirled streams 36 of fuel so as to form an toroidal vortex 54 that facilitates the mixing of the fuel and air and serves to stabilize the flame. According to the current invention, this mixing and subsequent combustion, however, does not result in the generation of excessive levels of noise.

The axially and tangentially introduced air streams 21 and 22, respectively, essentially form all of the air necessary for the stoichiometric combustion of the fuel 35. As shown in FIG. 2, additional portions of compressed air 20 from the compressor 1 are introduced into the combustor 15 primarily for cooling purposes, although portions of such air may also enter the combustion zone 53. Air streams 25 enter the combustor 15 axially by flowing through annular passages 48 formed between adjoining sections of the combustor liner 56 and serve to cool the liner walls. Air streams 23 enter the combustor radially by flowing through secondary air scoops 57 and serve to reduce the temperature of the hot gas 30 directed to the turbine section 3. As shown in FIG. 1, additional cooling air 24 is introduced radially into the combustor 15 by holes in the aft end of the combustor 15.

Although the invention has been discussed with reference to the combustor for a gas turbine, the invention is applicable to combustors in other applications as well. Consequently, the present invention may be embodied in other specific forms without departing from the spirit or essential attributes thereof and, accordingly, reference should be made to the appended claims, rather than to the foregoing specification, as indicating the scope of the invention.

We claim:

1. A combustor, comprising:

a) a liner for enclosing a combustion zone in which fuel and air are burned, said liner defining an axis of said combustor;

b) a fuel nozzle for introducing said fuel into said combustion zone, said fuel nozzle being disposed along said combustor axis and having means for directing fuel radially outward therefrom and for swirling said fuel circumferentially around said axis; and c) a plurality of air inlet passages disposed in said liner having means for introducing at least a first portion said air in which said fuel is burned tangentially into said combustion zone at a first acute angle relative to the radially inward direction so as to swirl said air circumferentially around said axis.

2. The combustor according to claim 1, wherein said means for swirling said fuel comprises means for directing said fuel at a second acute angle relative to the radially outward direction, and wherein said first and second angles differ by less than approximately 15°.

3. The combustor according to claim 2, wherein said first and second angles are approximately equal.

4. The combustor according to claim 3, wherein said first and second angles are each in the range of approximately 30° to 60°.

5. The combustor according to claim 1, wherein said means for swirling said fuel and said means for introducing said air tangentially into said combustion zone cooperate to swirl said fuel and said air in the same circumferential direction.

6. The combustor according to claim 1, wherein said means for introducing said fuel comprises means for introducing said fuel at an acute angle to said combustor axis so that said fuel is directed axially toward said combustion zone as well as radially outward.

7. The combustor according to claim 1, wherein said means for swirling said fuel comprises a plurality of fuel passages formed in said fuel nozzle and oriented at a second acute angle with respect to the radially outward direction.

8. The combustor according to claim 7, wherein said fuel nozzle has a face facing approximately toward said combustion zone, and wherein each of fuel passages has an outlet formed in said face.

9. The combustor according to claim 1, wherein each of said air inlet passages are oriented at said first acute angle relative to said radially inward direction.

10. The combustor according to claim 9, wherein said air passages encircle said combustion zone.

11. The combustor according to claim 9, further comprising a plurality of tubular members attached to said liner, said air inlet passages being formed in said tubular members.

12. The combustor according to claim 11, wherein said tubular members are circumferentially distributed around said liner.

13. The combustor according to claim 1, further comprising means for introducing a second of portion said air in which said fuel is burned into said combustion zone by directing said second portion of said compressed air into said combustion zone in the axial direction while swirling said second portion of said compressed air circumferentially around said axis.

14. The combustor according to claim 13, wherein said means for introducing said second portion of said air comprises a plurality of vanes circumferentially arranged around said fuel nozzle.

15. The combustor according to claim 13, wherein said means for introducing said fuel into said combustion zone and said means for introducing said first and second portions of said air into said combustion zone have means for swirling said fuel and said first and second portions of said compressed air in the same circumferential direction.

16. A gas turbine, comprising:

a) a compressor for producing compressed air;

b) a combustor for burning a fuel in said compressed air from said compressor so as to produce a hot gas, said combustor including:

(i) a liner for enclosing a combustion zone in which said fuel and compressed air are burned, said liner defining an axis of said combustor;

(ii) means for introducing substantially all of said fuel to be burned into said combustion zone by directing said fuel into said combustion zone in a direction inclined at a first acute angle to a first radial direction with respect to said combustor axis while swirling said fuel circumferentially around said axis;

(iii) first means for introducing compressed air into said combustion zone by directing at least a first portion of said compressed air into said combustion zone in a direction inclined at a second acute angle to a second radial direction with respect to said axis so as to swirl said compressed air circumferentially around said axis, said first and second radial directions being opposing; and c) a turbine for expanding said hot gas from said combustor.

17. The gas turbine according to claim 16, wherein said combustor further comprises second means for introducing compressed air into said combustion zone by directing a second portion of said compressed air into said combustion zone in the axial direction while swirling said second portion of said compressed air circumferentially around said axis.

18. The gas turbine according to claim 17, wherein said second means for introducing compressed air into said combustion zone comprises a circumferential array of vanes.

19. The gas turbine according to claim 17, wherein said means for introducing substantially all of said fuel and said first and second means for introducing compressed air into said combustion zone have means for swirling said fuel and said first and second portions of said compressed air in the same circumferential direction.

20. A method of reducing noise generated by combusting fuel in air, comprising the steps of:

a) forming a combustion zone within a combustor having an axis thereof;

b) introducing substantially all of said fuel into said combustion zone at a first acute angle to a first radial direction with respect to said combustor axis while swirling said fuel circumferentially therearound in a first circumferential direction; and c) introducing a major portion of said air into said combustion zone at a second acute angle to a second radial direction so as to swirl said air circumferentially therearound in said first circumferential direction, said first and second radial directions being opposed.

21. The method according to claim 20, wherein said first radial direction is outward and said second radial direction is inward.

22. The method according to claim 21, wherein said first and second acute angles are approximately equal.

23. The method according to claim 20, further comprising the step of introducing a minor portion of said air into said combustion zone by directing said minor portion of said air into said combustion zone in a direction substantially parallel to said combustor axis while swirling said minor portion of said air circumferentially around said axis in said first circumferential direction.

* * * * *